US011660735B1

(12) United States Patent
White, II

(10) Patent No.: US 11,660,735 B1
(45) **Date of Patent: *May 30, 2023**

(54) WRENCH ASSEMBLIES

(71) Applicant: John Terrel White, II, Gilbert, AZ (US)

(72) Inventor: John Terrel White, II, Gilbert, AZ (US)

( * ) Notice: Subject to any disclaimer, the term of this patent is extended or adjusted under 35 U.S.C. 154(b) by 750 days.

This patent is subject to a terminal disclaimer.

(21) Appl. No.: 16/686,716

(22) Filed: Nov. 18, 2019

Related U.S. Application Data

(63) Continuation of application No. 15/404,723, filed on Jan. 12, 2017, now Pat. No. 10,478,949.

(60) Provisional application No. 62/279,331, filed on Jan. 15, 2016.

(51) Int. Cl.

| | |
|---|---|
| ***B25B 23/00*** | (2006.01) |
| ***B25B 23/16*** | (2006.01) |
| ***B25G 1/04*** | (2006.01) |
| ***B25B 13/04*** | (2006.01) |
| ***B25B 13/08*** | (2006.01) |

(52) U.S. Cl.
CPC ..... *B25B 23/0007* (2013.01); *B25B 13/04* (2013.01); *B25B 13/08* (2013.01); *B25B 23/16* (2013.01); *B25G 1/043* (2013.01)

(58) Field of Classification Search
CPC ..... B25B 23/0007; B25B 13/04; B25B 13/08; B25B 23/16; B25G 1/043
See application file for complete search history.

(56) References Cited

U.S. PATENT DOCUMENTS

| | | | | |
|---|---|---|---|---|
| 1,030,592 | A * | 6/1912 | Leland | F16B 7/105 248/188.5 |
| 3,306,639 | A * | 2/1967 | Lyon | F16B 7/105 81/177.2 |
| 5,492,040 | A | 2/1996 | Bellas | |
| 5,964,132 | A * | 10/1999 | Chen | B25G 1/085 81/439 |
| 6,038,946 | A | 3/2000 | Jackson et al. | |
| 6,370,990 | B1 | 4/2002 | Lin | |
| D462,245 | S | 9/2002 | Friedman et al. | |
| 6,523,440 | B2 | 2/2003 | Friedman et al. | |
| 6,691,595 | B2 | 2/2004 | Hsien | |
| 7,024,969 | B2 | 4/2006 | Smith | |
| 7,322,264 | B2 | 1/2008 | Hu | |
| 7,712,397 | B2 | 5/2010 | Hu | |
| 8,136,427 | B2 | 5/2012 | James | |
| 2002/0078799 | A1 | 6/2002 | Friedman | |
| 2010/0175514 | A1 | 7/2010 | Hsieh | |
| 2010/0282035 | A1* | 11/2010 | Wang | B25G 3/10 81/489 |
| 2012/0174718 | A1 | 7/2012 | James | |

* cited by examiner

*Primary Examiner* — Brian D Keller
(74) *Attorney, Agent, or Firm* — Michael W. Goltry; Robert A. Parsons; Parsons & Goltry, PLLC

(57) ABSTRACT

A wrench assembly includes first and second wrench members, and a switch, having an engagement member and a proximal extremity, mounted to the first wrench member. The switch moves between engaging and disengaging positions of the engagement member. The proximal extremity is undepressed in the engagement member engaging position, and is depressed in the engagement member disengaging position. The switch moves from the engagement member engaging position to the engagement member disengaging position, when the second wrench member is partially installed into the first wrench member. The switch moves from the engagement member disengaging position to the engagement member engaging position releasably engaging the engagement member to the complemental engagement member disabling the second wrench member from being withdrawn from the first wrench member, when the engagement member registers with the complemental engagement member when the second wrench member is installed into the first wrench member.

7 Claims, 12 Drawing Sheets

WRENCH ASSEMBLIES

CROSS REFERENCE TO RELATED APPLICATION

This application claims the benefit of U.S. Provisional Pat. Application No. 62/279,331, filed Jan. 15, 2016, the entire contents of which are incorporated herein by reference.

FIELD OF THE INVENTION

The present invention relates generally to hand tools, and, more particularly, to wrenches useful for gripping and turning objects, such as bolts and nuts.

BACKGROUND OF THE INVENTION

Wrenches are useful hand tools used to provide grip and mechanical advantage in applying torque to turn objects, especially rotary fasteners, such as nuts and bolts, or keep them from turning. A typical single-ended wrench includes an open-end wrenching head at one end of a handle. Another typical single-ended wrench includes a closed-end or box-end wrenching head at one end of handle. Double-ended wrenches are also well known. A double-ended open-end wrench is a one-piece wrench with differently sized open-end wrenching heads at either end. A double-ended closed-end or box-end wrench is a one-piece with differently sized closed-end or box-end wrenching heads at either end. A combination wrench is a one-piece double-ended wrench with an open-end wrenching head at one end and a closed-end or box-end wrenching head at the other end.

In an effort to improve single-ended wrenches and double-ended wrenches, skilled artisans have developed a variety of wrench assemblies consisting of single-ended wrenches that can be used independently and that are configured to be connected to form a double-ended wrench in the absence of the need to independently employ the single-ended wrenches. Although such prior art wrench assemblies are useful, they are expensive, structurally complex, difficult to assemble and disassemble, employ fastening mechanisms do not satisfactorily connect the single-ended wrenches and that are susceptible to deformation when objects are torqued aggressively. Given these and other deficiencies in the art, the need for continued improvement in the art is evident.

SUMMARY OF THE INVENTION

According to the principle of the invention, a wrench assembly includes a first member, a second member, and a switch. The first member includes a first wrenching component and a first handle. The second member includes a second wrenching component and a second handle. The first handle is sufficiently hollow to enable the second handle to be inserted into the first handle. The switch is mounted to the first handle and includes a proximal extremity, a distal extremity, and an engagement member. The switch moves between an engaging position of the engagement member and a disengaging position of the engagement member. The proximal extremity is in an undepressed position, when the engagement member is in the engaging position. The proximal extremity is in a depressed position, when the engagement member is in the disengaging position. The proximal extremity is exteriorly operable by hand for movement between the undepressed position and the depressed position. A complemental engagement member is carried by the second handle. The second handle acts on the distal extremity of the switch to move the switch from the engaging position of the engagement member to the disengaging position of the engagement member, when the second handle is inserted into the first handle to a partially installed position. The switch moves from the disengaging position of the engagement member to the engaging position of the engagement member releasably engaging the engagement member to the complemental engagement member disabling the second handle from being withdrawn from the first handle, when the engagement member registers with the complemental engagement member when the second handle is inserted into the first handle beyond the partially installed position to an installed position. The switch moves from the engaging position of the engagement member to the disengaging position of the engagement member releasing the engagement member from the complemental engagement member enabling the second handle to be withdrawn from the first handle, when the second handle is in the installed position and when the proximal extremity of the switch is moved from the undepressed position to the depressed position. A spring keeps tension on the switch urging the switch toward the engaging position of the engagement member. The engagement member is one of a strike and a penetrator, and the complemental engagement member is the other one of the strike and the penetrator. The switch is mounted pivotally to the first handle for pivotal movement between the engaging position of the engagement member and the disengaging position of the engagement member. The switch further includes an intermediate part between the proximal extremity and the distal extremity, wherein the switch is mounted pivotally to the first handle at the intermediate part. The second handle engages the intermediate part when the second handle advances through the first handle to the installed position from the partially installed position before the switch moves from the disengaging position of the engagement member to the engaging position of the engagement member, disabling the second handle from advancing through the first handle beyond the installed position. The intermediate part is in direct contact against an inner surface of the first handle, when the switch is in the engaging position of the engagement member, when the switch is in the disengaging position of the engagement member, and when the switch moves between the engaging position of the engagement member and the disengaging position of the engagement member. The first wrenching component is one of an open-end wrench head and a box-end wrench head. The second wrenching component is the other one of the open-end wrench head and the box-end wrench head.

According to the principle of the invention a wrench assembly includes a first member, a second member, and a switch. The first member includes a first wrenching component and a first handle. The first handle includes a hollow section, a switch opening to the hollow section, and the switch opening is proximate to the first wrenching component. The second member includes a second wrenching component and a second handle. The switch mounted to the hollow section at the switch opening. The switch includes a proximal extremity, a distal extremity, and an engagement member. The switch moves between an engaging position of the engagement member and a disengaging position of the engagement member. The proximal extremity is in an undepressed position, when the engagement member is in the engaging position. The proximal extremity is in a depressed position, when the engagement member is in the disengaging position. The proximal extremity is exteriorly operable by hand for movement between the undepressed position and the depressed position. The proximal extremity and the distal extremity of the switch concurrently extend outwardly from the switch opening, when the switch is in the engaging position of the engagement member. The switch is inclined from the proximal extremity of the switch to the distal extremity of the switch, the proximal extremity of the switch extends through the switch opening into the hollow section, and the distal extremity of the switch extends outwardly from the hollow section through the switch opening, when the switch is in the disengaging position of the engagement member. A complemental engagement member is carried by the second handle. The second handle acts on the distal extremity of the switch to move the switch from the engaging position of the engagement member to the disengaging position of the engagement member, when the second handle is inserted into the hollow section to a partially installed position. The switch moves from the disengaging position of the engagement member to the engaging position of the engagement member releasably engaging the engagement member to the complemental engagement member disabling the second handle from being withdrawn from the hollow section, when the engagement member registers with the complemental engagement member when the second handle is inserted into the hollow section beyond the partially installed position to an installed position. The switch moves from the engaging position of the engagement member to the disengaging position of the engagement member releasing the engagement member from the complemental engagement member enabling the second handle to be withdrawn from the hollow section, when the second handle is in the installed position and when the proximal extremity of the switch is moved from the undepressed position to the depressed position. A spring keeps tension on the switch urging the switch toward the engaging position of the engagement member. The engagement member is one of a strike and a penetrator, and the complemental engagement member is the other one of the strike and the penetrator. The switch is mounted pivotally to the hollow section for pivotal movement between the engaging position of the engagement member and the disengaging position of the engagement member. The switch further includes an intermediate part between the proximal extremity and the distal extremity, wherein the switch is mounted pivotally to the hollow section at the intermediate part. The second handle engages the intermediate part when the second handle advances through the hollow section to the installed position from the partially installed position before the switch moves from the disengaging position of the engagement member to the engaging position of the engagement member, disabling the second handle from advancing through the hollow section beyond the installed position. The intermediate part is in direct contact against an inner surface of the hollow section, when the switch is in the engaging position of the engagement member, when the switch is in the disengaging position of the engagement member, and when the switch moves between the engaging position of the engagement member and the disengaging position of the engagement member. The first wrenching component is one of an open-end wrench head and a box-end wrench head. The second wrenching component is the other one of the open-end wrench head and the box-end wrench head.

BRIEF DESCRIPTION OF THE DRAWINGS

Referring to the drawings.

DETAILED DESCRIPTION

Figure 1:
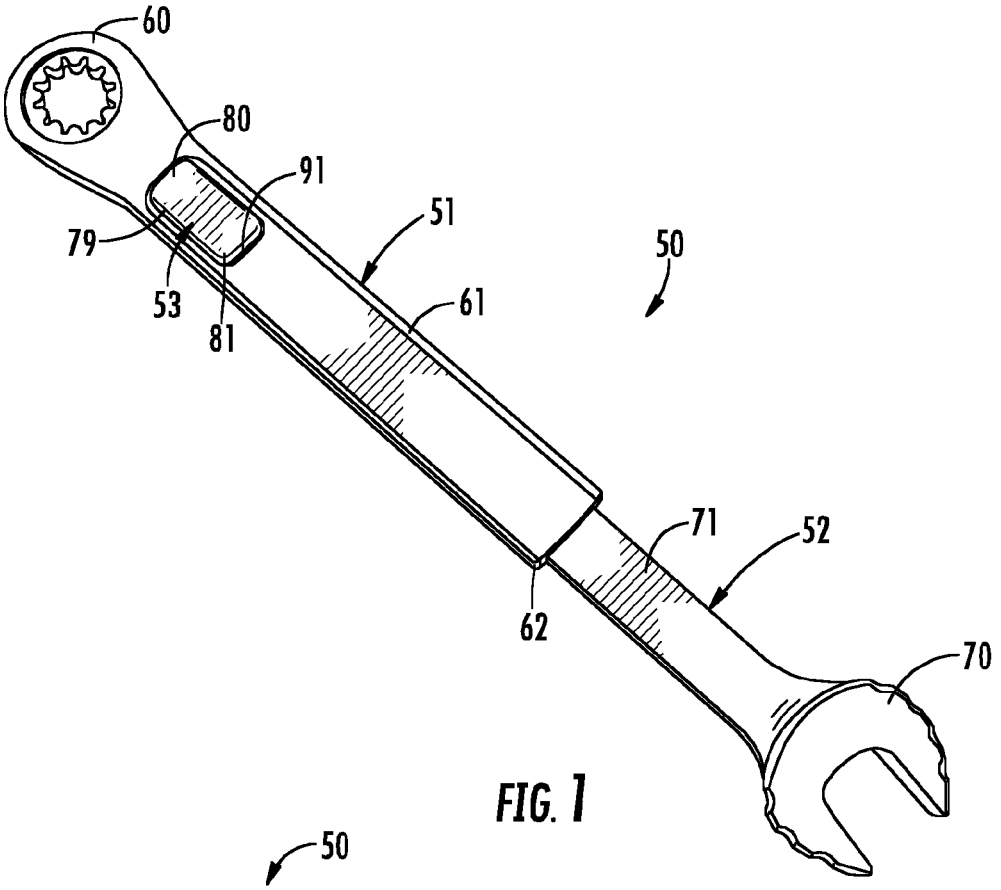
FIG. 1 is a top perspective view of a wrench assembly constructed in accordance with the teachings of the present invention, the wrench assembly includes a first wrench member, a second wrench member installed into the first wrench member, a switch coupled between the first wrench member and the second wrench member, and the switch is shown in a locking position disabling the second wrench member from being withdrawn from the first wrench member.

Turning now to the drawings, in which like reference characters indicate corresponding elements throughout the several views, attention is first directed in relevant part to FIGS. 1-6 in which there is seen a wrench assembly 50 including first member 51, second member 52, and switch 53. First member 51, a wrench member, includes first wrenching component 60 and first handle 61. Second member 52, also a wrench member, includes second wrenching component 70 and second handle 71. First handle 61 is sufficiently hollow to enable second handle 71 to be inserted longitudinally into first handle 61. Switch 53 is mounted to first handle 61 of first member 51, and includes proximal extremity 80 and distal extremity 81. Switch 53 moves between a locking position in FIGS. 1-3, and an unlocking position in FIGS. 4-6. Proximal extremity 80 is in an undepressed position, when switch 53 is in the locking position in FIGS. 1-3. Proximal extremity 80 is in a depressed position, when switch 53 is in the unlocking position in FIGS. 4-6. Proximal extremity 80 is exteriorly operable by hand for movement between the undepressed and depressed positions. Second handle 71 acts on distal extremity 81 of switch 53 in FIGS. 12 and 13 to move switch 53 from its locking position in FIG. 12 to its unlocking position in FIG. 13, when second handle 71 is inserted into first handle 61 to a partially installed position. Switch 53 moves from its unlocking position in FIG. 14 to its locking position in FIG. 15 releasably engaging second handle 71 to switch 53 disabling second handle 71 from being withdrawn from first handle 61, when second handle 71 is inserted into first handle 61 beyond its partially installed position in FIG. 13 to its installed position into first handle 61 in FIGS. 14 and 15. Switch 53 moves from its locking position in FIG. 15 to its unlocking position in FIG. 14 releasing switch 53 from second handle 71 enabling second handle 71 to be withdrawn from first handle 61 in FIGS. 7 and 8, when second handle 71 is in the installed position in first handle 61 and when proximal extremity 80 of switch 53 is moved from its undepressed position in FIG. 15 to its depressed position in FIG. 14. When first and second members 51 and 52 are interconnected in FIGS. 1-3, wrench assembly 50 is an assembled double-ended wrench, being exemplary of an assembled combination wrench in this example. The overall length of the overlapping first and second handles 61 and 71, concurrently aligned along a longitudinal axis, of wrench assembly 50 is sufficiently long to enable gripping by hand for using wrench assembly 50 to selectively grip or turn objects. When first and second members 51 and 52 are separated in FIGS. 7 and 8, first and second members 51 and 52 can be taken up by hand by their respective first and second handles 61 and 71 and used independently for selectively gripping and twisting or turning objects.

Figure 7:
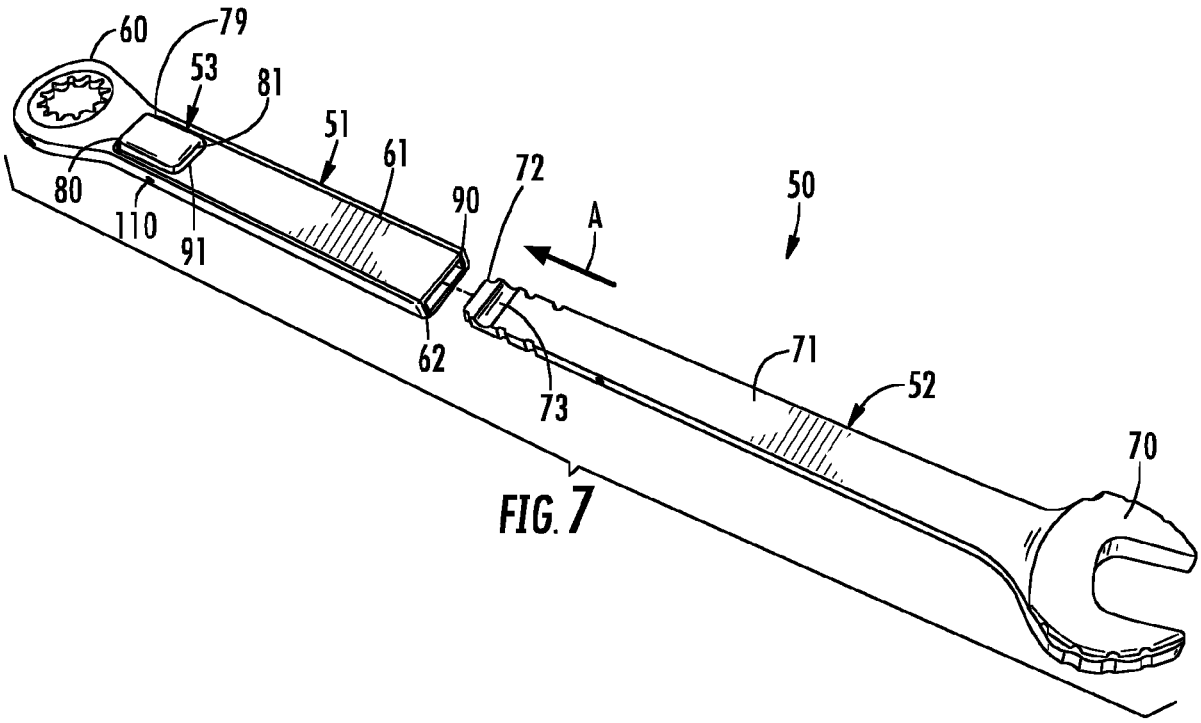
FIGS. 7 and 8 are perspective views corresponding to the illustrations of FIGS. 4 and 5 illustrating the second wrench member withdrawn from the first wrench member.
Figure 8:
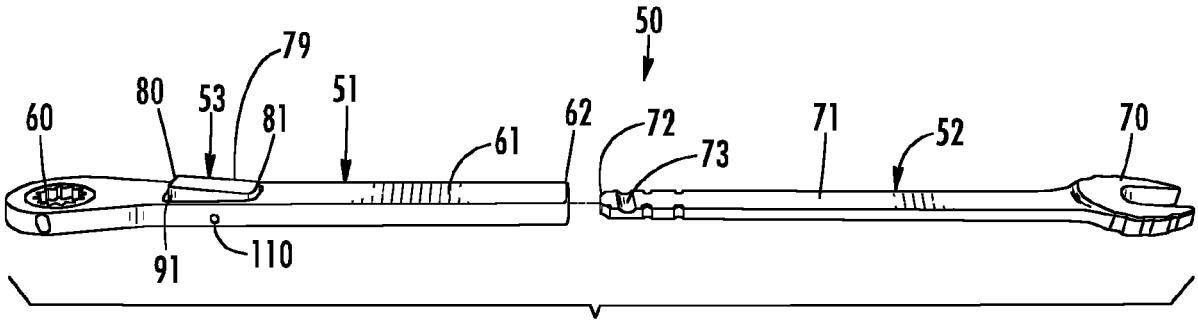

Referring to FIGS. 7 and 8, which illustrate first and second members 51 and 52 disassembled, first and second members 51 and 52 are each preferably formed from metal, a metal allow, a sintered powdered material, a high-strength plastic or similar material, or other material or combination of materials known by the skilled artisan to make it suitable for use as a tool. First member 51 includes first wrenching component 60 and first handle 61. First wrenching component 60 is a wrenching head in the form of a conventional box-end wrench head useful for gripping an object to be turned or twisted, such as nut or a bolt. First handle 61 is elongate and rectangular in cross-section and extends longitudinally from first wrenching component 60 to outer or free end 62. Second member 52 includes second wrenching component 70 and second handle 71. Second wrenching component 70 is a wrenching head in the form of a conventional open-end wrench head useful for gripping an object to be turned or twisted, such as nut or a bolt. First and second wrenching components 60 and 70 can be similarly sized, or differently sized. Second handle 71 is elongate and rectangular in cross-section and extends longitudinally from second wrenching component 70 to outer or free end 72. Strike 73, a groove or recess, is formed adjacent to free end 72.

As explained above, first handle 61 is sufficiently hollow to enable second handle 71 to be inserted into first handle 61 longitudinally. In particular, first handle 61 includes hollow section 90, which has a hollow rectangular internal cross-section corresponding to the rectangular cross-section of second handle 71 and which extends from proximate to first wrenching component 60 in FIGS. 9 and 12-15 to free end 62 in FIG. 7. Hollow section 90 is formed with switch opening 91 in FIG. 9. Switch opening 91 to hollow section 90 is proximate to first wrenching component 60. The corresponding rectangular shapes of second handle 71 and hollow section 90 produces a close sliding fit between second handle 71 and hollow section 90, and disables first and second members 51 and 52 from rotating relative to one another, when second handle 71 is inserted into hollow section 90.

Figure 9:
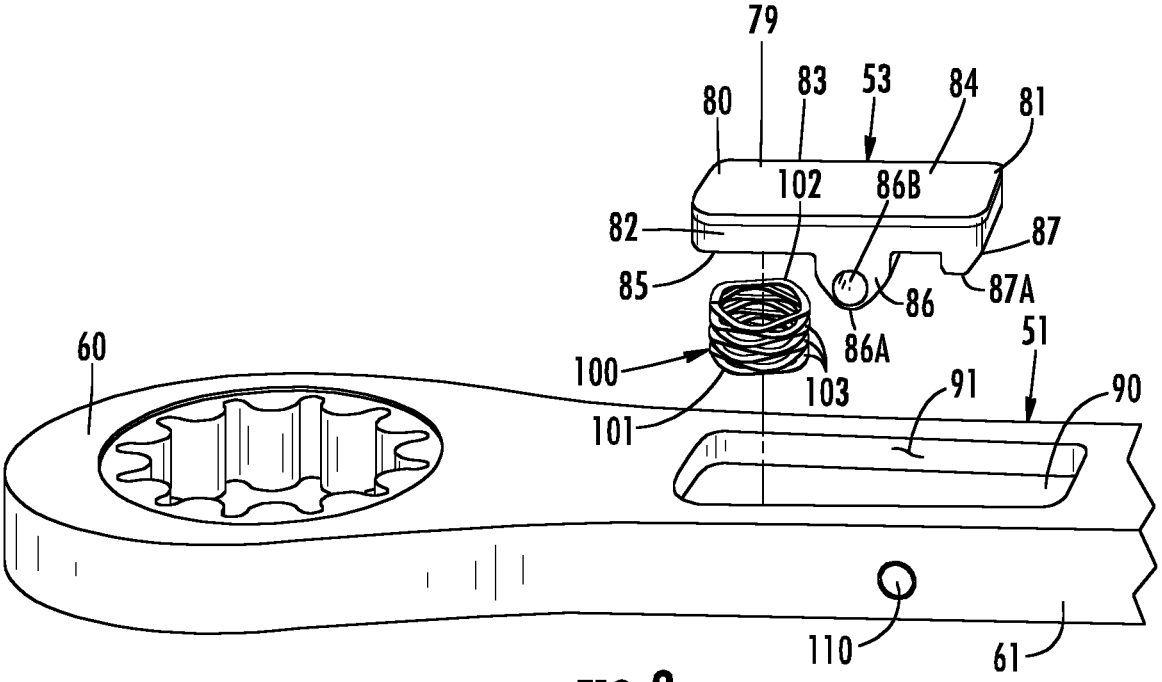
FIG. 9 is an enlarged, fragmentary, partially exploded view of the first wrench member of FIG. 1 illustrating the switch and a spring removed from the first wrench member.
Figure 10:
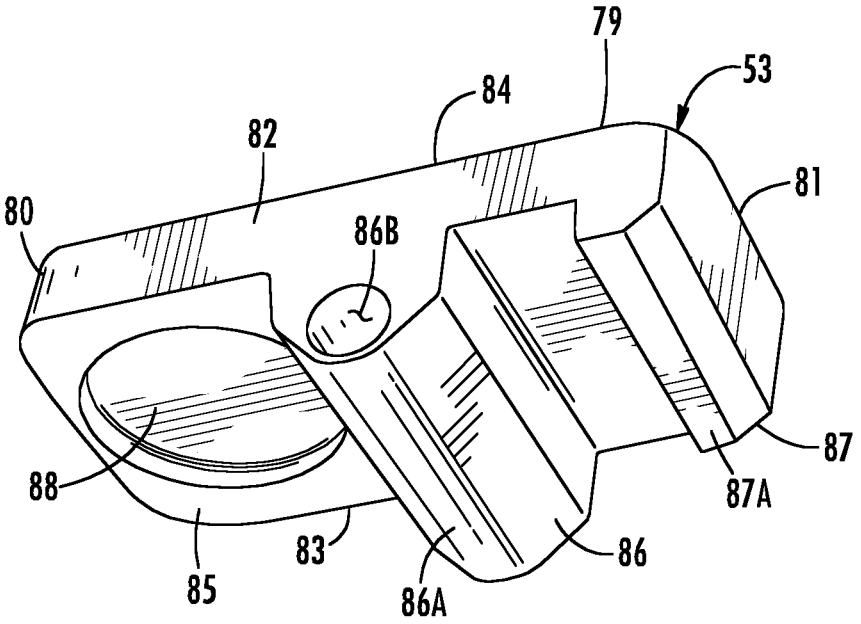
FIG. 10 is an underside perspective view of the switch corresponding to the illustration of FIG. 9.
Figure 11:
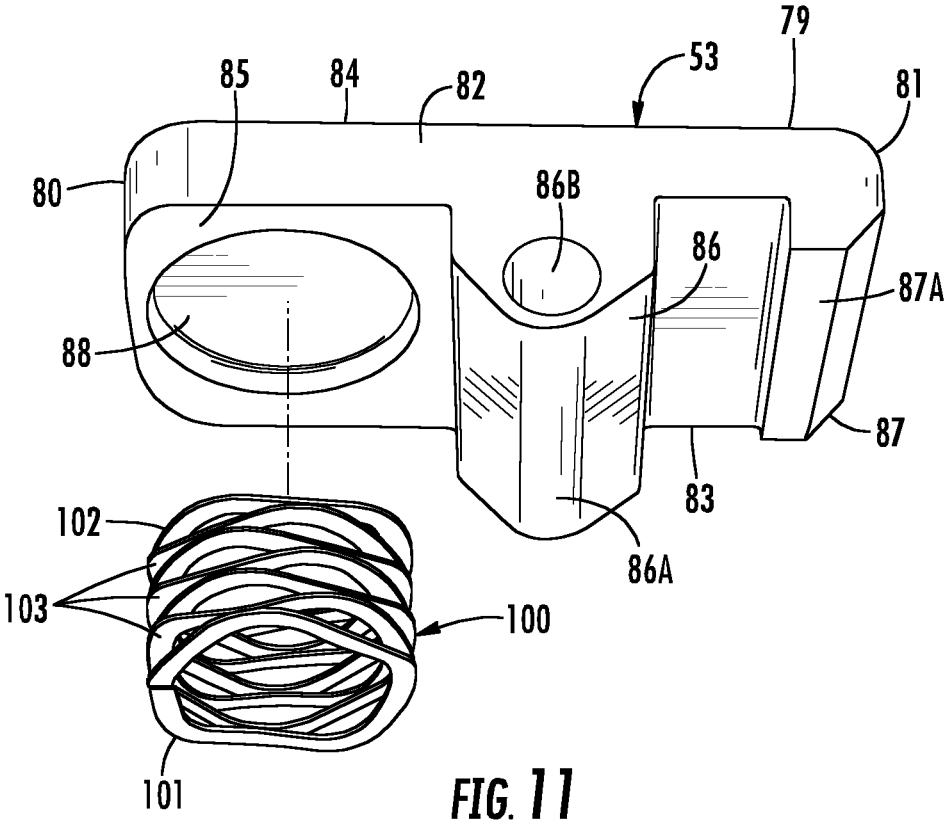
FIG. 11 is a view corresponding to the illustration of FIG. 9 illustrating the spring registered with a recess formed in an underside of the switch.

Switch 53 is mounted to hollow section 90 at switch opening 91 in FIGS. 12-15. In FIGS. 9-11, switch 53 is an integral, unitary body, fashioned of the same material or combination of materials as first and second members 51 and 52, including main part 79 having proximal extremity 80, distal extremity 81, opposed sides 82 and 83 that extend from proximal extremity 80 to distal extremity 81, upper or top surface 84, and bottom surface or undersurface 85. Intermediate part 86, a projection, is between proximal and distal extremities 80 and 81 and depends downwardly from undersurface 85 to outer end 86A. Intermediate part 86, including outer end 86A, extends from side 82 to side 83. Outer end 86A is blunt-pointed. A pin-receiving channel 86B extends through intermediate part 86 from side 82 to side 83 of switch 53. Engagement member 87, a nose or penetrator, is part of distal extremity 81 and depends downwardly from undersurface 85 at distal extremity 81 to outer end 87A, and extends from side 82 to side 83 like intermediate part 86. Recess 88 is formed in undersurface 85 between intermediate part 86 and proximal extremity 80 and between sides 82 and 83. FIG. 11 illustrates spring 100, which is a compression spring having an innermost coil 101, an outermost coil 102, and a plurality of active coils 103 therebetween. Recess 88 is shaped to accept outermost coil 102.

Figure 12:
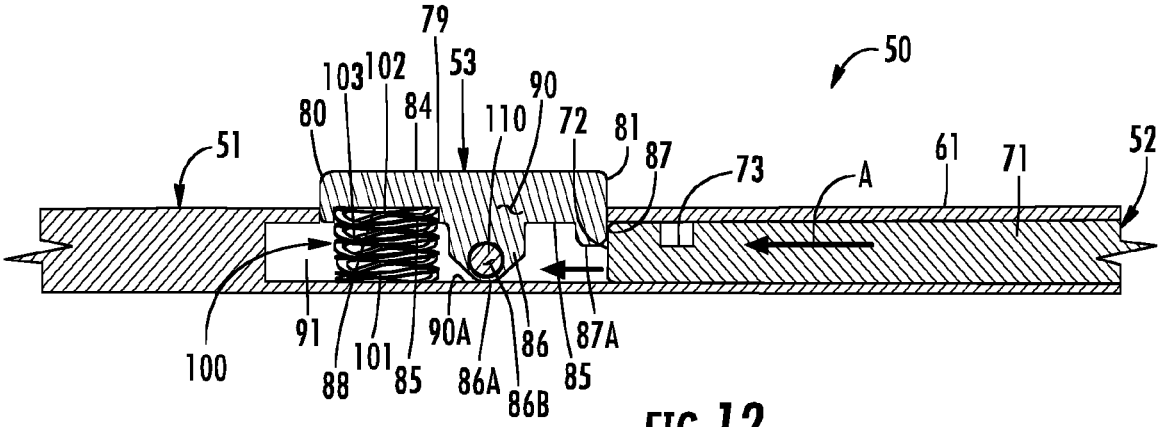
FIGS. 12-15 are enlarged section views illustrating a sequence of events for connecting the second wrench member to the first wrench member to form the embodiment of FIGS. 1-3.

In FIG. 12, switch 53 is positioned in hollow section 90 through switch opening and extends upright through hollow section 90 from outer end 86A of intermediate part 86 positioned direction against inner surface 90A of hollow section 90 opposite to switch opening 91 to main part 79 at switch opening 91. Main part 79 extends exteriorly outwardly from hollow section 90 of first handle 61 from switch opening 91. Spring 100 is positioned in hollow section 90 between inner surface 90A of hollow section 90 and recess 88 of switch 52. Innermost coil 101 is in direct contact against inner surface 90A of hollow section 90, and outermost coil 102 is in, and is in direct contact against, recess 88 of switch 53. Switch 53 is mounted pivotally to hollow section 90 of first handle 61 at intermediate part 86 via pivot pin 110 applied through pin-receiving channel 86B for movement between its locking position in FIGS. 1-3, and its unlocking position in FIGS. 4-6. The opposed ends of pivot pin 110 are affixed to either side of hollow section 90. In this example, switch 53 pivots relative to pivot pin 110. Outer end 86A of intermediate part 86 is in direct contact against inner surface 90A of hollow section 90 of first handle 61, when switch is in its locking position in FIGS. 12 and 15, when switch 53 is in its unlocking position in FIGS. 13 and 14, and when switch 53 moves between its locking position in FIGS. 12 and 15 and its unlocking position in FIGS. 13 and 14. Spring 100 acts against inner surface 90A of hollow section 90 and recess 88 of switch 52, wherein spring 100 keeps constant tension on switch 53 constantly urging switch 53 toward its locking position. Switch 53 is, therefore, spring-loaded, being constantly spring-tensioned toward its locking position.

Figure 14:
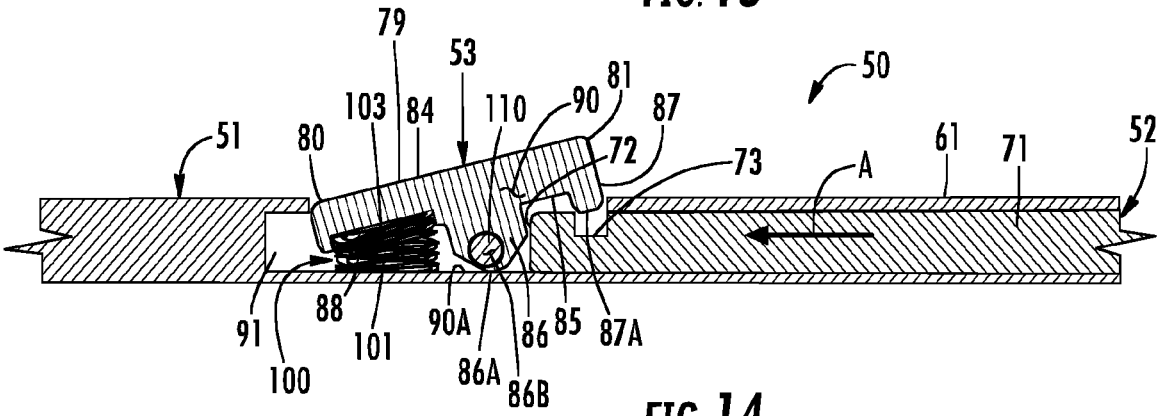
Figure 15:
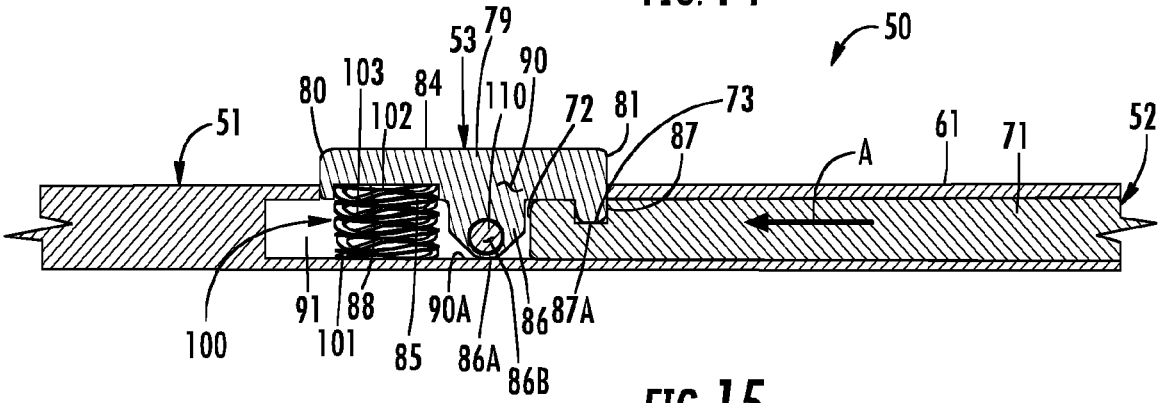

Engagement member 87 is in an engaging position when switch 53 is in its locking position in FIGS. 12 and 15. Engagement member 87 is in a disengaging position when switch 53 is in its unlocking position in FIGS. 13 and 14. Accordingly, switch 53 moves between the engaging position of engagement member 87 in FIGS. 12 and 15 when switch 53 is in its locking position, and the disengaging position of engagement member 87 in FIGS. 13 and 14 when switch 53 is in its unlocking position.

When first and second members 51 and 52 are separated from one another in FIGS. 7 and 8, they can be taken up by hand by their respective first and second handles 61 and 71 and used independently from one another for gripping and turning objects, such as bolts and nuts. In particular, first handle 61 of first member 51 is sufficiently long to enable a skilled worker to take up first handle 61 by hand and use first member 51 to grip and turn or twist a chosen object, and second handle 71 of second member 52 is sufficiently long to enable a skilled worker to take up second handle 71 by hand and use second member 52 to grip and turn or twist a chosen object.

Figure 2:
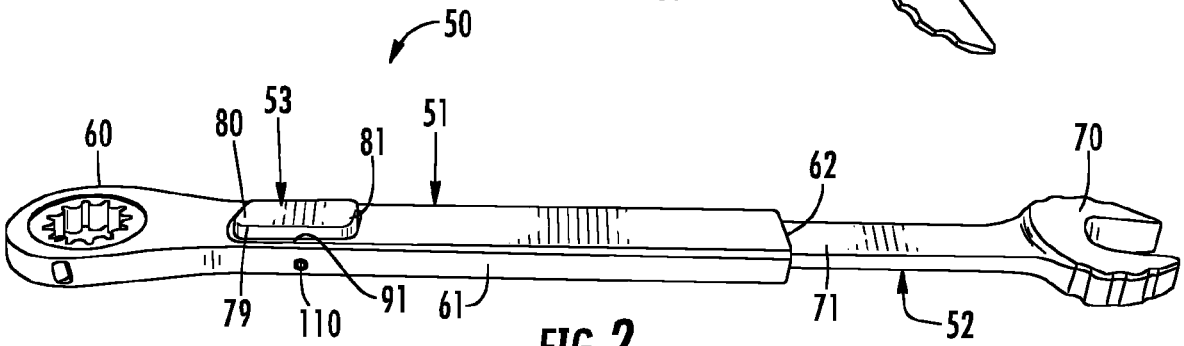
FIG. 2 is a side perspective view of the embodiment of FIG. 1.
Figure 3:
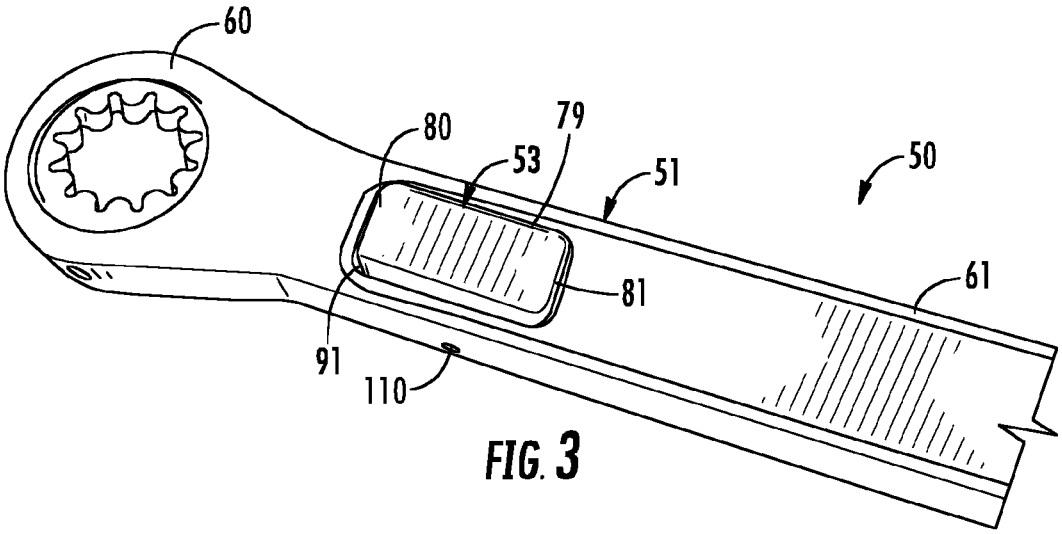
FIG. 3 is an enlarged fragmentary view corresponding to the illustrations of FIGS. 1 and 2 showing the switch in greater detail.
Figure 4:
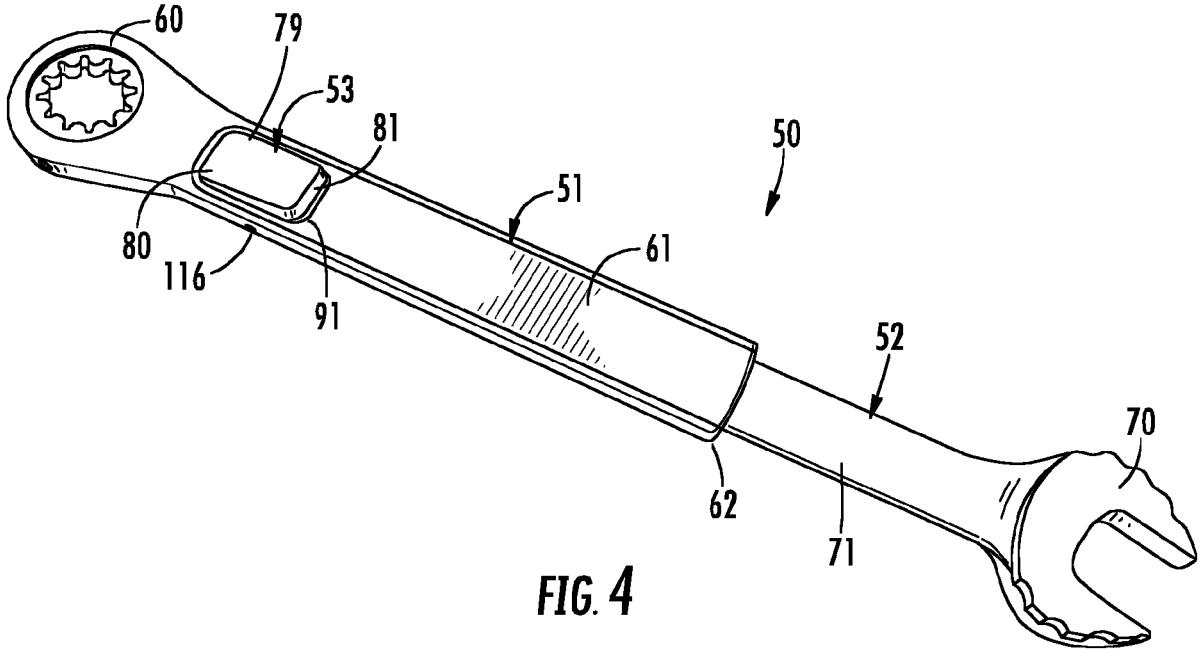
FIG. 4 is a view corresponding to the illustration of FIG. 1 showing the switch in an unlocking position enabling the second wrench member to be withdrawn from the first wrench member.
Figure 5:
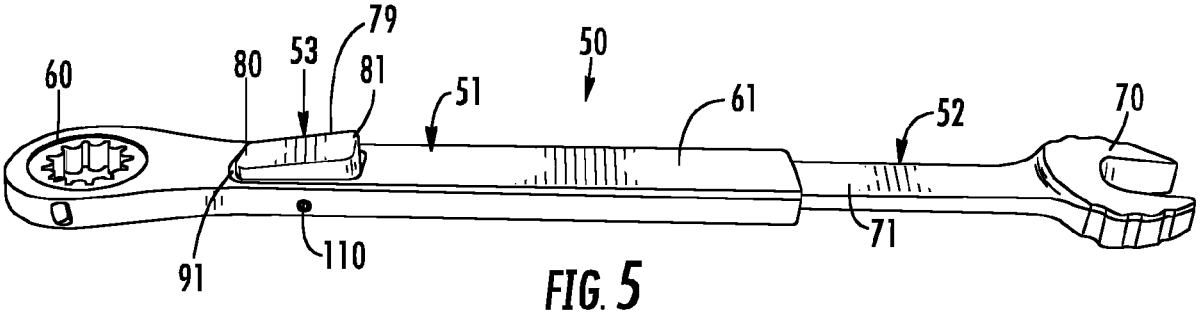
FIG. 5 is a side perspective view of the embodiment of FIG. 4.
Figure 6:
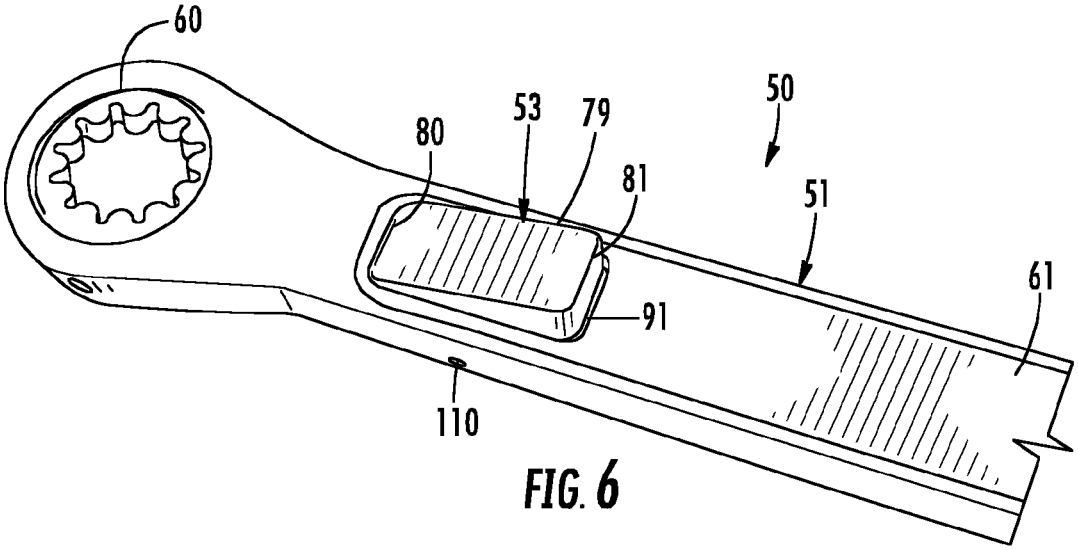
FIG. 6 is an enlarged fragmentary view corresponding to the illustrations in FIGS. 4 and 5 showing the switch in greater detail.
Figure 13:
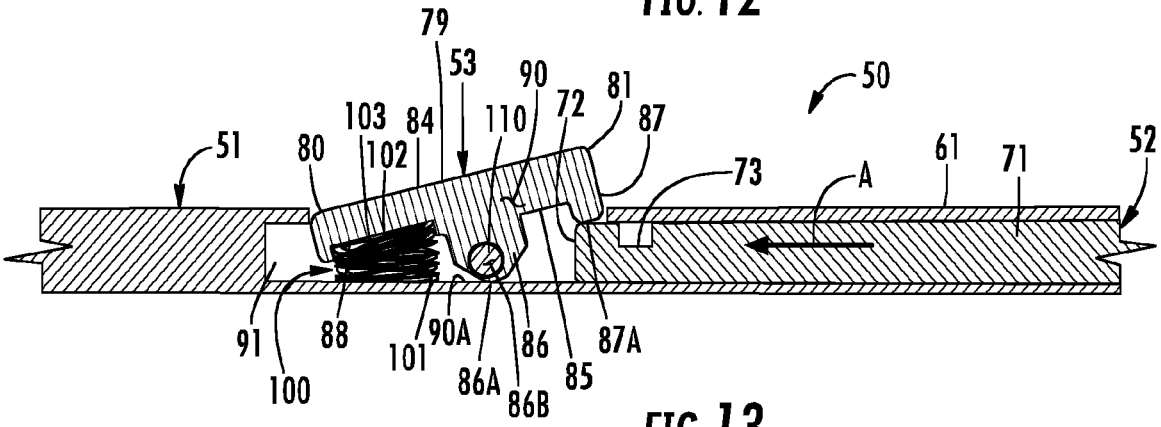

To interconnect first and second members 51 and 52 to form an assembled double-ended wrench, the embodiment depicted in FIGS. 1-3, first and second handles 61 and 71 are aligned end 62 to end 72 longitudinally in FIG. 7 and second member 51 is moved in the direction of arrowed line A inserting free end 72 of second member 51 into hollow section 90 through free end 62 of first handle 61. Second handle 71 is forcibly advanced through hollow section 90 in the direction of arrowed line A in FIG. 12 and free end 72 strikes engagement member 87 when second handle 71 is advanced through hollow section 90 of first handle 61 to a partially installed position in FIG. 12, which pivots switch 53 from its locking position in FIG. 12 to its unlocking position in FIG. 13 in response, displacing engagement member 87 of distal extremity 81 upwardly into switch opening 91 out of the way of free end 72 enabling free end 72 to pass beyond engagement member 87 to enable continued advancement of second handle 71 through hollow section 90 of first handle 61 in the direction of arrowed line A beyond the partially installed position in FIGS. 12 and 13 to the installed position of second handle 71 in FIG. 14, while at the same time displacing proximal extremity 80 downwardly into hollow section 90 from switch opening 91 compressing spring 100 between recess 88 and inner surface 90A of hollow section 90. The leading surface of engagement member 87 against which free end 72 initially contacts is in-turned in the direction toward wrenching component 60 away from free end 62 to promote deflection of switch 53 from its locking position to its unlocking position when free end 72 strikes engagement element 87 when second handle 71 is advanced into hollow section 90 of first handle 61 to its partially installed position in FIG. 12. In FIG. 14, free end 72 of second handle 71 engages intermediate part 86 when second handle 71 advances through hollow section 90 of first handle 61 to its installed position from its partially installed position in FIG. 13 before switch 53 moves from its locking position corresponding to the disengaging position of engagement member 87 in FIG. 14 to the locking position of switch 53 corresponding to the engaging position of engagement member 87 in FIG. 15, disabling second handle 71 from advancing through hollow section 90 of first handle 61 beyond its installed position. And so advancement of second handle 71 through hollow section 90 in the direction of arrowed line A in FIG. 13 is arrested when free end 72 of second handle 71 strikes intermediate part 86. When free end 72 strikes intermediate part 86, second handle 71 is installed into hollow section 90 of first handle 61, and engagement member 87, a nose or penetrator, registers with strike 73, a complemental engagement element. When engagement member 87 registers or otherwise aligns with strike 73 in FIG. 14 when second handle 71 is installed into hollow section 90 of first handle 61, the constant spring 100 tension against switch 53 forcibly pivots switch 53 from its unlocking position in FIG. 14 to its locking position in FIG. 15 displacing engagement member 87 of distal extremity 81 downwardly into strike 73 and into hollow section 90 from switch opening 91, while at the same time displacing proximal extremity 80 upwardly into switch opening 91 from hollow section 90 decompressing spring 100 between recess 88 and inner surface 90A of hollow section 90. When engagement member 87 is inserted into, i.e. penetrates, strike 73, engagement member 87 and strike 73 are releasably engaged, which releasably engages second handle 71 to switch 53 disabling second handle 71 from being withdrawn from first handle 61. Engagement member 87, a nose or penetrator, and strike 73, a corresponding groove, form a detent, a device used to mechanically secure second handle 71 to switch 53 for, in turn, connecting first handle 61 of first member 51 to second handle 71 of second member 52, thereby forming wrench assembly 50 in FIGS. 1-3, an assembled double-ended wrench, being exemplary of an assembled combination wrench in this example.

To separate first member 51 from second member 52 when second handle 71 is in its installed position in first handle 61 and when switch 53 is in its locking position, switch 53 is pivoted from its locking position in FIG. 15 to its unlocking position in FIG. 14 by pushing forcibly down on proximal extremity 80 by hand displacing engagement member 87 of distal extremity 81 upwardly from hollow section 90 and into switch opening 91 out of the way of free end 72 withdrawing engagement member 87 from strike 73, while at the same time displacing proximal extremity 80 downwardly into hollow section 90 from switch opening 91 compressing spring 100 between recess 88 and inner surface 90A of hollow section 90, enabling second handle 71 to be withdrawn from hollow section 90 of first handle 61 in the direction of arrowed line B in FIG. 14 until fully withdrawn from first handle 61 in FIG. 7. The process of coupling and decoupling first and second members 51 and 52 is repeated as necessary depending on whether the skilled worker selects to utilize wrench assembly 50 as an assembled double-ended wrench in FIGS. 1-3 or to use first and second members 51 and 52 separately.

In sum, and referring in relevant part to FIGS. 1-15, wrench assembly 50 includes first member 51, second member 52, and switch 53. First member 51 includes first wrenching component 60 and first handle 61. First handle 61 includes hollow section 90, and switch opening 91 to hollow section 90. Switch opening 91 is proximate to first wrenching component 60. Second member 52 includes second wrenching component 70 and second handle 71. Switch 53, a non-electric, unpowered, manually-operated mechanical switch, is mounted to hollow section 90 at switch opening 91. Switch 53 includes proximal extremity 80, distal extremity 81, and engagement member 87. Switch 53 moves between the engaging position of engagement member 87 when switch 53 is in its locking position and the disengaging position of engagement member 87 when switch 53 is in the unlocking position. Proximal extremity 80 is in its undepressed position, when engagement member 87 is in the engaging position. Proximal extremity 80 is in a depressed position, when engagement member 87 is in the disengaging position, in FIGS. 13 and 14. Proximal extremity 80 is exteriorly operable by hand for movement between the undepressed position and the depressed position. Proximal extremity 80 and distal extremity 81 of switch 53 concurrently extend outwardly from switch opening 91, when switch 53 is in the engaging position of engagement member 87 in FIGS. 12 and 15. Switch 53 is inclined from proximal extremity 80 of switch 53 to distal extremity 81 of switch 53, proximal extremity 80 of switch 53 extends through switch opening 91 into hollow section 90, and distal extremity 81 of switch 53 extends outwardly from hollow section 90 through switch opening 91, when switch 53 is in the disengaging position of engagement member 87 in FIGS. 13 and 14. The complemental engagement member, strike 73, is carried by second handle 71. Second handle 71 acts on distal extremity 81 of switch 53 to move switch 53 from the engaging position of engagement member 87 to the disengaging position of engagement member 87, when second handle 71 is inserted into hollow section 90 of first handle 61 to its partially installed position in FIGS. 12 and 13. Switch 53 moves from the disengaging position of engagement member 87 to the engaging position of engagement member 87 releasably engaging engagement member 87 to the complemental engagement member, strike 73, disabling second handle 71 from being withdrawn from hollow section 90 of first handle 61, when engagement member 87 registers with the complemental engagement member, strike 73, when second handle 71 is inserted into hollow section 90 of first handle 61 beyond its partially installed position in FIG. 13 to its installed position into hollow section 90 of first handle 61 in FIGS. 14 and 15. Switch 53 moves from engaging position of engagement member 87 to the disengaging position of engagement member 87 releasing engagement member 87 from the complemental engagement member, strike 73, enabling second handle 71 to be withdrawn from hollow section 90 of first handle 61, when second handle 71 is in its installed position in hollow section 90 of first handle 61 and when proximal extremity 80 of switch 53 is moved from the undepressed position in FIG. 15 to the depressed position in FIG. 14. Spring 100 keeps tension on switch 53 urging switch 53 toward the engaging position of engagement member 87. Engagement member 87 is a nose or penetrator, complemental engagement member is strike 73, and this arrangement can be reversed in an alternate embodiment. Switch 53 is mounted pivotally to hollow section 90 for pivotal movement between the engaging position of engagement member 87 and the disengaging position of engagement member 87. Specifically, intermediate part 86 of switch 53 is mounted pivotally to hollow section 90. In FIG. 14, free end 72 of second handle 71 engages intermediate part 86 when second handle 71 advances through hollow section 90 of first handle 61 to its installed position from its partially installed position in FIG. 13 before switch 53 moves from its locking position corresponding to the disengaging position of engagement member 87 in FIG. 14 to the locking position of switch 53 corresponding to the engaging position of engagement member 87 in FIG. 15, disabling second handle 71 from advancing through hollow section 90 of first handle 61 beyond its installed position. Intermediate part 86 is in direct contact against inner surface 90A of hollow section 90, when switch 53 is in the engaging position of engagement member 87, when switch 53 is in the disengaging position of engagement member 87, and when switch 53 moves between the engaging position of engagement member 87 and the disengaging position of engagement member 87. This constant contact of engagement member 87, specifically outer end 86A of engagement member 87, against inner surface 90A of hollow section 90 produces a frictional contact that disables excessive play between switch 53 hollow section 90.

Figure 16:
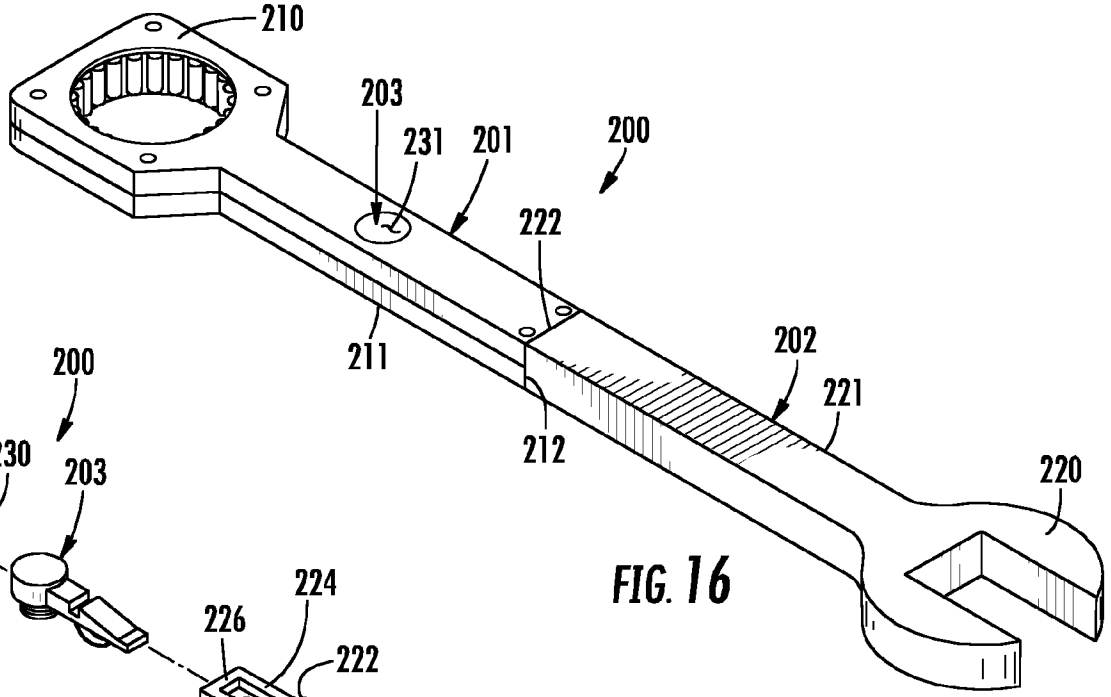
FIG. 16 is perspective view of an alternate embodiment of a wrench assembly constructed in accordance with the teachings of the present invention, the wrench assembly includes a first wrench member, a second wrench member installed into the first wrench member, and a switch coupled between the first wrench member and the second wrench member for disabling the second wrench member from being withdrawn from the first wrench member.

FIG. 16 is a perspective view of an alternate embodiment of a wrench assembly 200 including first member 201, second member 202, and switch 203. First member 201, a wrench member, includes first wrenching component 210 and first handle 211. Second member 202, also a wrench member, includes second wrenching component 220 and second handle 221. First handle 211 is sufficiently hollow to enable second handle 221 to be inserted longitudinally into first handle 211. Switch 223 is mounted to first handle 211 of first member 201, and is for releasably securing first handle 211 to second handle 221 when second handle 221 is inserted into first handle 211 in an installed position. Switch 203 is exteriorly operable by hand for movement between an undepressed position corresponding to a locking position of switch 203 for releasably securing first handle 211 to second handle 221 when second handle 221 is inserted into first handle 211 in the installed position, and a depressed position corresponding to an unlocking position of switch 203 for enabling second handle 221 to be withdrawn from first handle 211. When first and second members 201 and 202 are interconnected in FIG. 6, wrench assembly 200 is an assembled double-ended wrench, being exemplary of an assembled combination wrench in this example. The overall length of the joined first and second handles 211 and 221, concurrently aligned along a longitudinal axis, of wrench assembly 200 is sufficiently long to enable gripping by hand. When first and second members 201 and 202 are separated in FIG. 17, first and second members 201 and 202 can be taken up by hand by their respective first and second handles 211 and 221 and used independently for gripping and twisting or turning objects.

Figure 17:
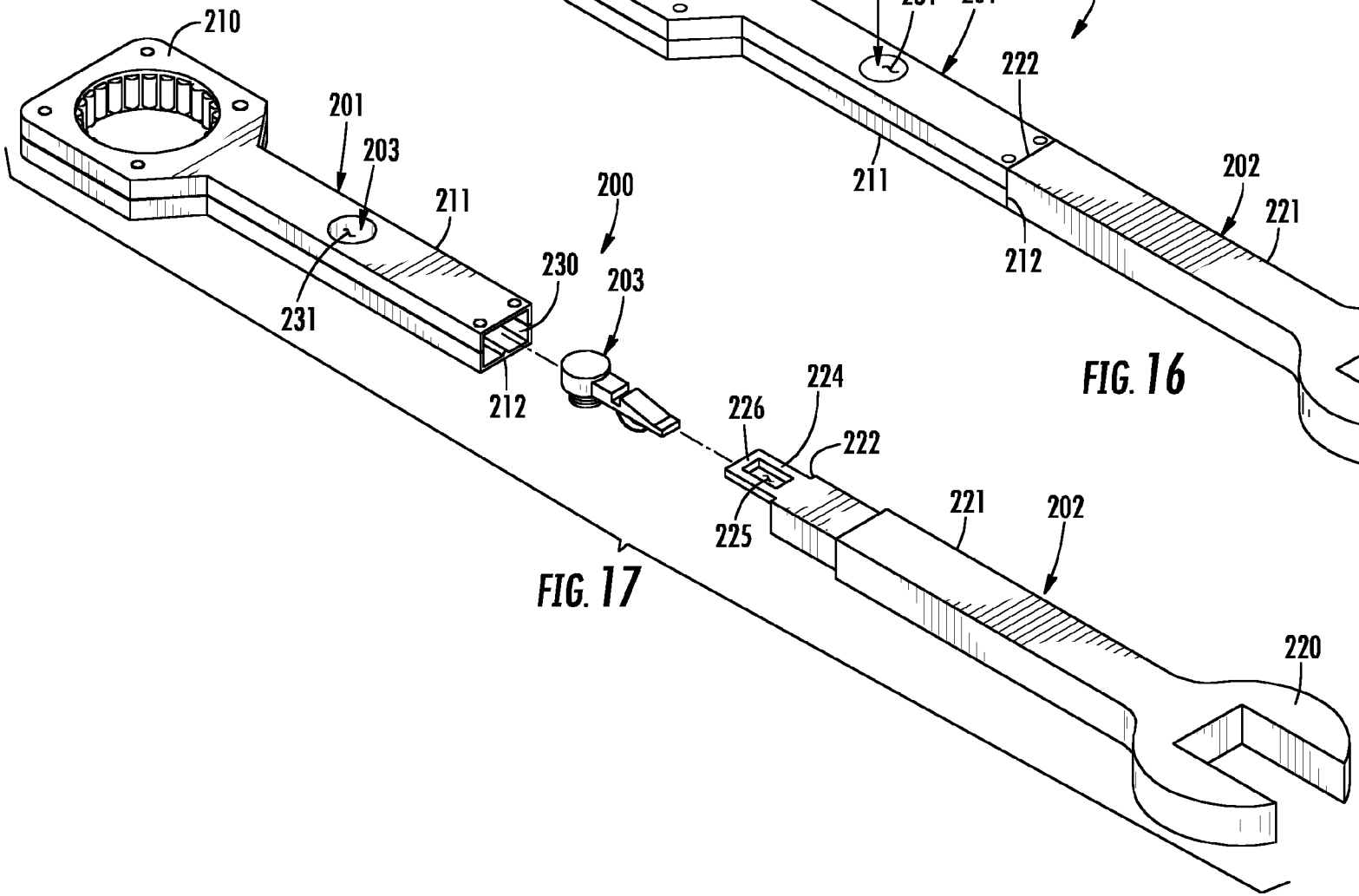
FIG. 17 is an exploded perspective view of the wrench assembly of FIG. 16.

Referring to FIG. 17, first and second members 201 and 202 are each preferably formed from metal, a metal allow, a sintered powdered material, a high-strength plastic or similar material, or other material or combination of materials known by the skilled artisan to make it suitable for use as a tool. First member 201 includes first wrenching component 210 and first handle 211. First wrenching component 210 is a wrenching head in the form of a box-end wrench head useful for gripping an object to be turned or twisted, such as nut or a bolt. First handle 211 is elongate and rectangular in cross-section and extends longitudinally from first wrenching component 210 to outer or free end 212. Second member 202 includes second wrenching component 220 and second handle 221. Second wrenching component 220 is a wrenching head in the form of an open-end wrench head useful for gripping an object to be turned or twisted, such as nut or a bolt. First and second wrenching components 210 and 220 can be similarly sized, or differently sized. Second handle 221 is elongate and rectangular in cross-section and extends longitudinally from second wrenching component 220 to outer extremity 222, formed with tongue 224 having opening 225 therethrough so as to define an outermost crosspiece or transom 226, which is an engagement element of second member 202.

As explained above, first handle 211 is sufficiently hollow to enable second handle 221 to be inserted into first handle 211 longitudinally. In particular, first handle 211 includes hollow section 230, which has a hollow rectangular internal cross-section corresponding to the rectangular cross-section of outer extremity 222 of second handle 221 and which extends partially inwardly into first handle 211 from free end 212. Hollow section 90 is formed with switch opening 91 in FIG. 9. Switch opening 231 to hollow section 230 is between first wrenching member 220 and free end 212. The corresponding rectangular shapes of outer extremity 222 of second handle 221 and hollow section 230 produces a close sliding fit between outer extremity 222 of second handle 221 and hollow section 230 and disables first and second members 201 and 202 from rotating relative to one another, when outer extremity 222 of second handle 221 is inserted into hollow section 230.

Figure 18:
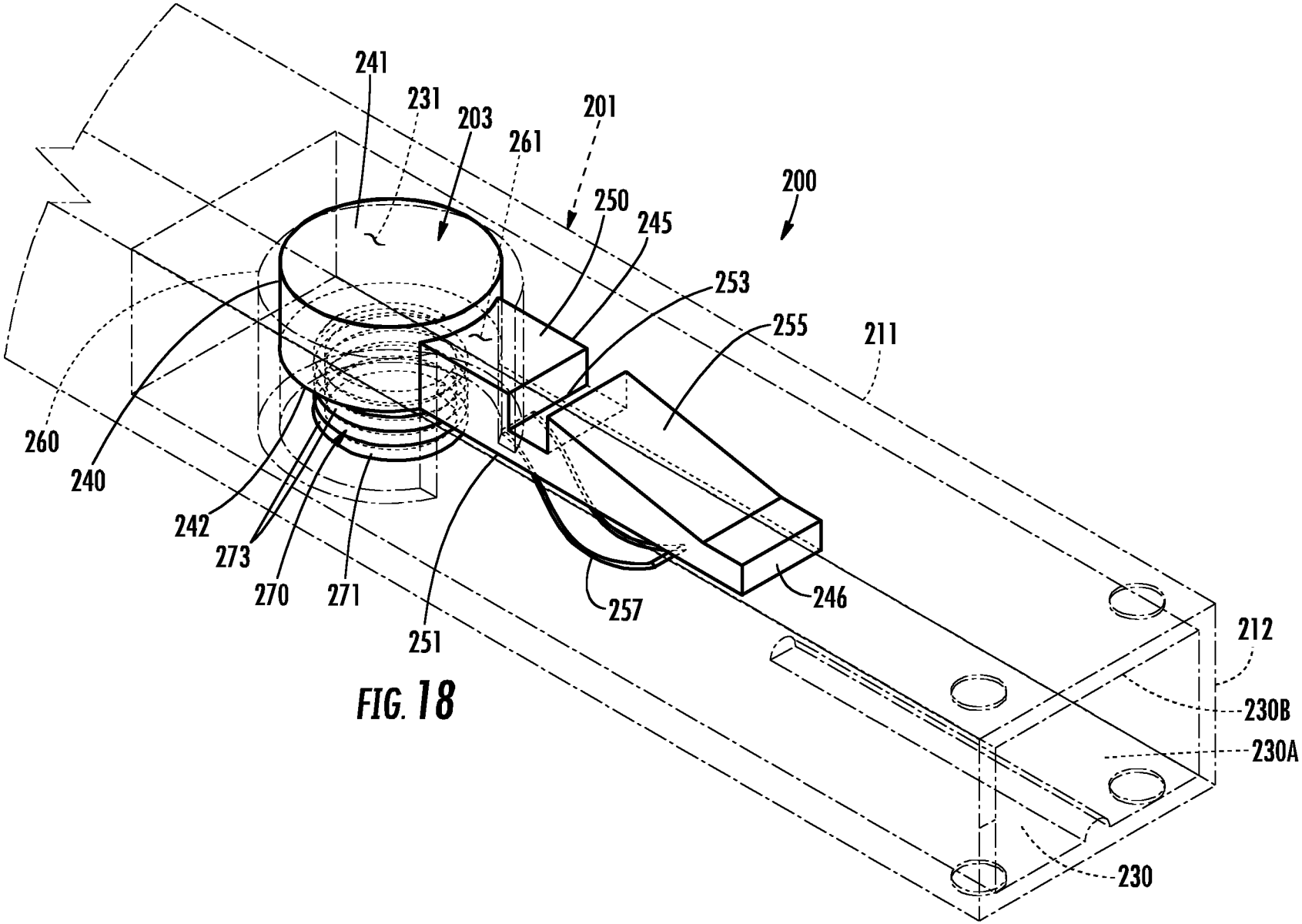
FIG. 18 is a perspective view corresponding to FIG. 16 illustrating the first wrench member in phantom line to better illustrate the switch therein.
Figure 19:
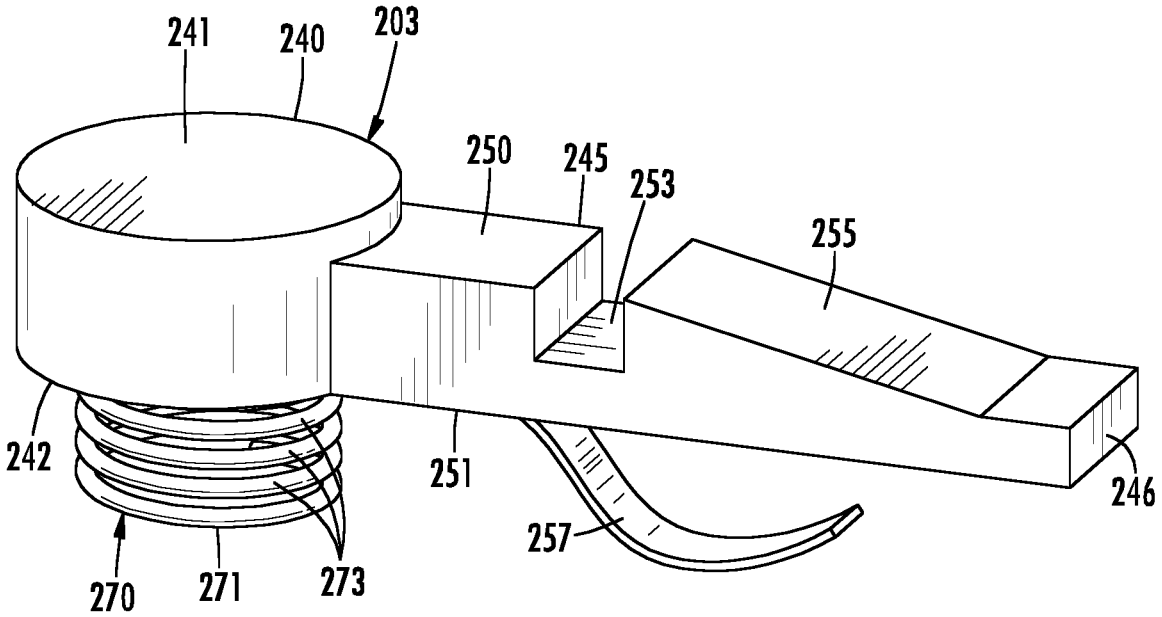
FIG. 19 is an enlarged perspective view of the switch corresponding to the illustration of FIG. 18.

Referring to FIGS. 18 and 19 in relevant part, switch 203 is a non-electric, unpowered, manually-operated mechanical switch. Switch 203 is an elongate integral body, fashioned of the same material or combination of materials as first and second members 201 and 202 discussed above, including button 240, having upper and lower ends 241 and 242, and arm 245 that projects outwardly from button 240 to distal extremity 246. Arm 245 has opposed top and bottom sides 250 and 251. A complemental engagement element of switch 203, strike 253 is formed in top side 250 between button 240 and distal extremity 246. Ramp 255 formed in top side 250 declines downwardly from strike 253 to proximate to distal extremity 246. Flyleaf spring 257 projects downwardly from bottom side 251 of arm 245 under strike 253 and ramp 255.

Figure 20:
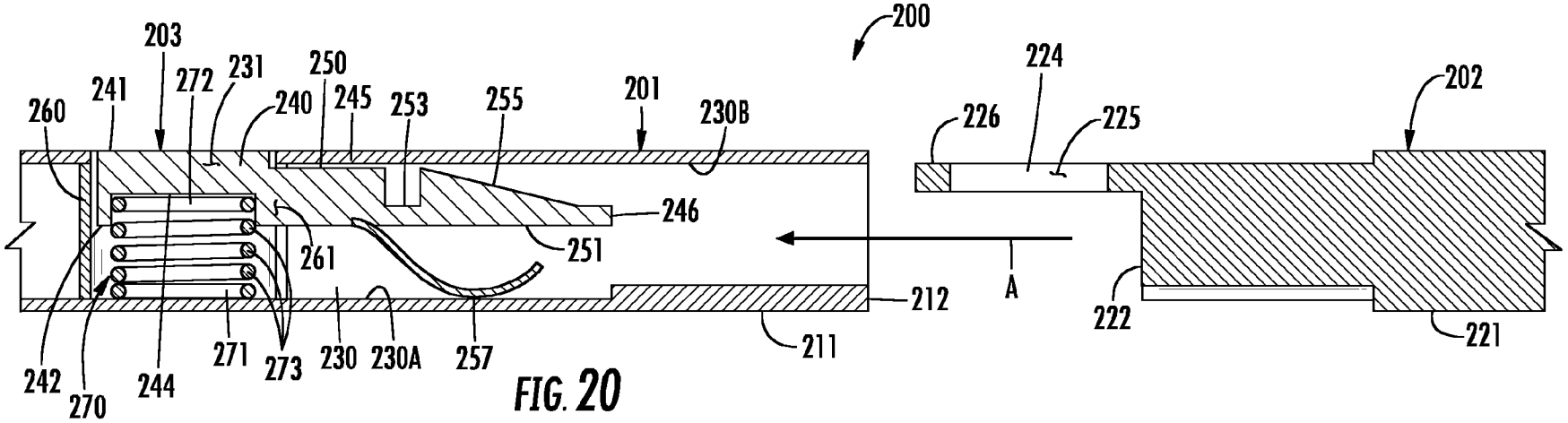
FIGS. 20-23 are enlarged section views illustrating a sequence of events for connecting and disconnecting wrench members corresponding to the embodiment in FIG. 16.

Button 240 is circular in this example, as is switch opening 231 in FIGS. 16 and 17. In FIGS. 18 and 20, C-shaped collar 261 is formed in hollow section 230 and is affixed rigidly in place via welding, heat bonding, or the like. Collar 261 projects upright from lower inner surface 230A of hollow section 230 to switch opening 231, which is circular in this example. Switch 203 is positioned in hollow section 230 and extends upright through hollow section 230, and extends from button 240 forwardly to distal extremity 246 toward free end 212. Button 203 is within and is captively held or otherwise retained by collar 261 and extends upright in collar 261 from lower end 242 to upper end 241 proximate to switch opening 231. Spring 270, a compression spring having an innermost coil 271, an outermost coil 272, and a plurality of active coils 273 therebetween, is positioned in hollow section 230 within collar 261 between inner surface 230A of hollow section 230 and recess 244 formed in lower end 242 of button 240. Innermost coil 271 is in direct contact against inner surface 230A of hollow section 230, and outermost coil 272 is in, and is in direct contact against, recess 244 formed in lower end 242 of button 240. Arm 245 projects outwardly through opening 261 of collar 261 in the direction of free end 62 (not shown) of first arm 61 to distal extremity 246. Button 240 is larger than collar 260 opening 261, whereby button 240 is captively held by collar 260 and button 240 is disabled from withdrawing from collar 260 through opening 261. This retains switch 203 in place. Spring 257, a flyleaf spring, is embedded in switch 203 and projects downwardly from bottom side 251 of arm 245 under strike 253 and ramp 255 to against inner surface 230A of hollow section 230. Spring 270 concurrently acts against inner surface 230A of hollow section 230 and recess 244 of switch 203, and at the same time flyleaf spring 257 acts against inner surface 230A of hollow section 230 and bottom side 251 of arm 245, wherein spring 270 and flyleaf spring 257 concurrently keep constant tension on switch 203 constantly urging switch 203 upwardly away from inner surface 230A of hollow section 230 to opposed inner surface 230B of hollow section toward its locking position. Switch 203 is, therefore, spring-loaded, being constantly spring-tensioned toward its locking position. Upper end 241 of button 240 is applied to switch opening 231 and does not extend exteriorly of hollow section 230 beyond switch opening 231 for disabling inadvertent contact with upper end 241 of switch 203 and top side 250 of arm 245 is juxtaposed with inner surface 230A of hollow section 230, when switch 203 is in its locking position in FIG. 20.

Figure 21:
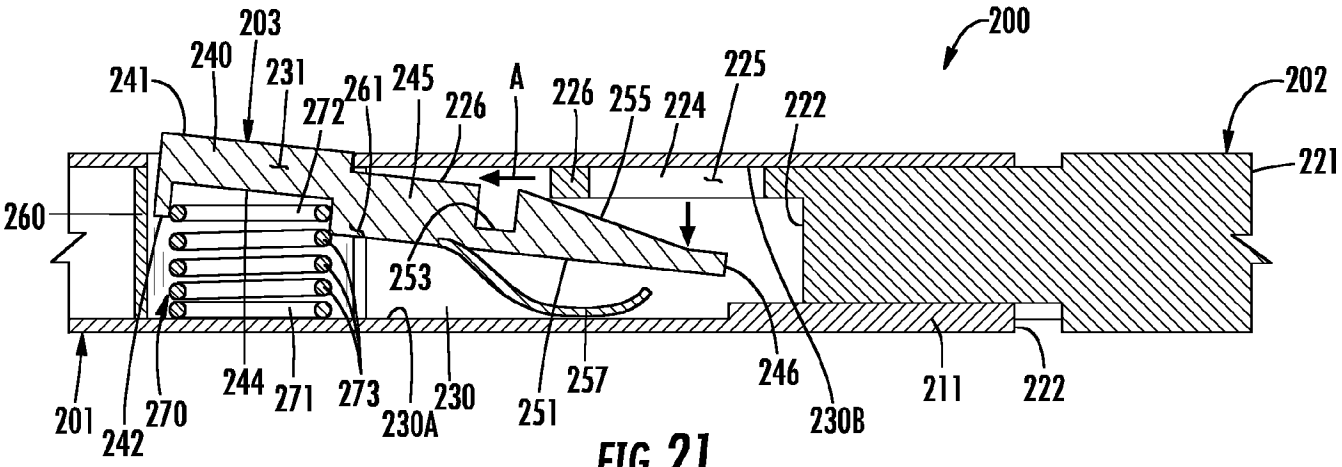

To interconnect first and second members 201 and 202 to form an assembled double-ended wrench in FIG. 16, first and second members 201 and 201 are aligned longitudinally free end 212 to outer extremity 222 and second member 201 is moved in the direction of arrowed line A in FIGS. 20 and 21 inserting outer extremity 222 tongue 224 first into hollow section 230 of first handle 211 through free end 212. Second handle 221 is forcibly advanced through hollow section 230 in the direction of arrowed line A in FIG. 21 so as to bring tongue 224, which is aligned with ramp 255, in contact with ramp 255. Tongue 224 acts on ramp 255 in response to the continued advancement of second handle 221 into hollow section 230 of first handle 211, which overcomes flyleaf spring 257 and displaces arm 245 of switch 250 downwardly from its locking position in FIG. 20 away from inner surface 230B toward inner surface 230A in FIG. 21. Continued advancement of second handle 221 in the direction of arrowed line A continues to drive tongue 224 against ramp 255 and deflect arm 245 downwardly in response until transom 226 clears ramp 255 and registers with strike 253 and ramp 255 concurrently registers with opening 225 of tongue 224 in FIG. 22, which enables flyleaf spring 257 to snap the downwardly-displaced arm 245 upwardly from its unlocked position back to its locked position in FIG. 22 in response, driving strike 253, the complemental engagement element of switch 203, over transom 226, the engagement element of second handle 221, while at the same time driving ramp 255 through opening 225. When transom 226 and registers with strike 253 and ramp 255 concurrently registers with opening 225 in FIG. 22, second handle 221 is in an installed position in hollow section 230 of first handle 211. When transom 226 is inserted into, i.e. penetrates, strike 253, transom 226 is releasably engaged to switch 203, which releasably engages second handle 221 to switch 203 disabling second handle 221 from being withdrawn from hollow section 230 of first handle 211. Strike 253 and transom 226 form a detent, a device used to mechanically secure second handle 221 to switch 203 for, in turn, connecting first handle 211 of first member 201 to second handle 221 of second member 202, thereby forming an assembled double-ended wrench in FIG. 16.

Figure 23:
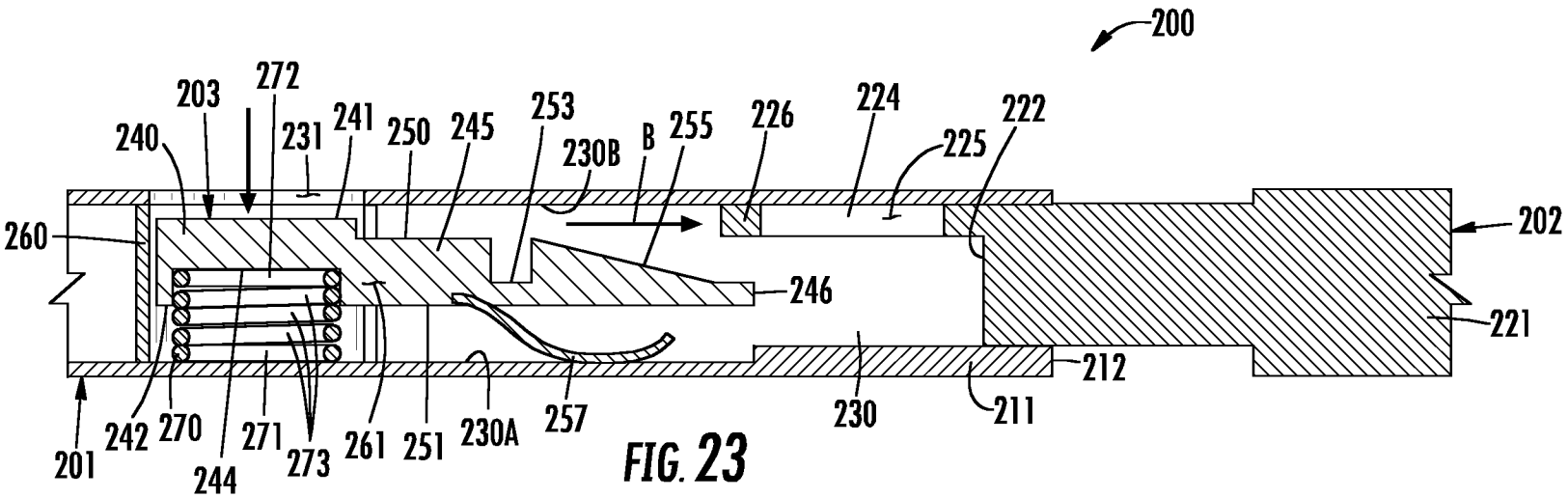

To separate first member 201 from second member 202 when second handle 221 is in its installed position in first handle 211 and when switch 203 is in its locking position, switch 203 is lowered away from its locking position toward inner surface 230A of hollow section 230 by pushing forcibly down on upper end 241 of button 240 at switch opening 231 by hand withdrawing strike 253 from transom 246 while at the same time withdrawing ramp 255 from opening 225 of tongue and concurrently compressing spring 270 between recess 244 and inner surface 230A and flyleaf spring 257 between bottom side 251 of arm 245 and inner surface 230A of hollow section 230, enabling second handle 221 to be withdrawn from hollow section 230 of first handle 211 in the direction of arrowed line B in FIG. 23 until fully withdrawn from first handle 211. The process of coupling and decoupling first and second members 201 and 202 with switch 203 is repeated as necessary depending on whether the skilled worker selects to utilize an assembled double-ended wrench in FIG. 16 or to use first and second members 201 and 202 separately.

Figure 22:
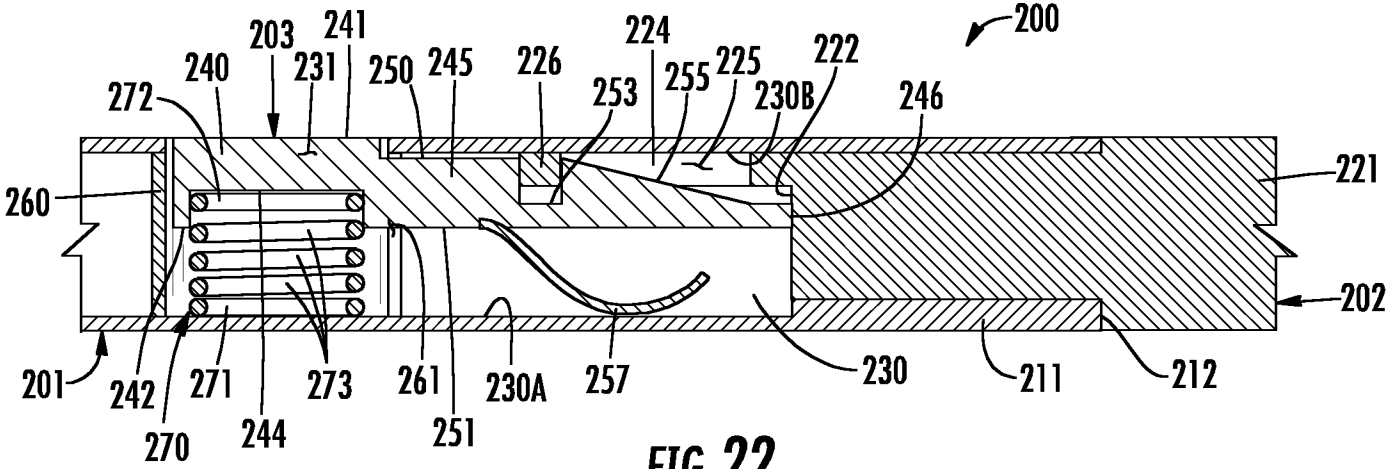
Figure 24:
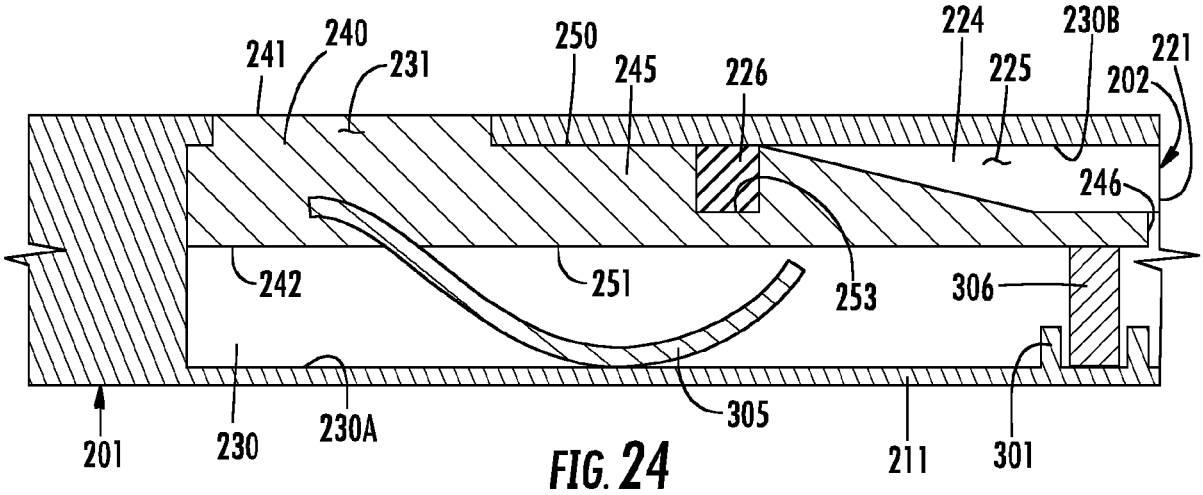
FIG. 24 is longitudinal section view similar to that of FIG. 22 illustrating an alternate embodiment of a switch useful for releasably connecting the first wrench member to the second wrench member corresponding to the illustration of FIG. 16.

FIG. 24 is longitudinal section view similar to that of FIG. 22 illustrating an alternate embodiment of a switch 300, a non-electric, unpowered, manually-operated mechanical switch, useful for releasably connecting first wrench member 201 to second wrench member 202 corresponding to the illustration of FIG. 16. In FIG. 24, collar 260 discussed in the embodiment denoted at 200 is absent, and is replaced with socket 301, which is forward of switch opening 231 to hollow section 230 and which projects upright from inner surface 230A. In common with switch 200, switch 300 shares button 240, upper end 241, lower end 242 absent recess 244, arm 245, distal extremity 246, opposed top and bottom sides 250 and 251, strike 253, and ramp 255. In switch 300, a single spring 305, a flyleaf spring, is embedded in switch 300 and projects downwardly from lower end 242 of button 240 under strike 253 and ramp 255, and a pin 306 depends downwardly from bottom side 251 of arm 245 proximate to distal extremity 246 into socket 301, which holds switch 300 in place in hollow section 230 of first handle 211.

Switch 300 is positioned in hollow section 230 and extends upright through hollow section 230, and extends from button 240 forwardly to distal extremity 246 toward free end 212 (not shown). Button 300 and extends upright from lower end 242 to upper end 241 proximate to switch opening 231. Flyleaf spring 305 projects downwardly from switch 300 centrally under arm 245 and strike 253 to against inner surface 230A of hollow section 230. Flyleaf spring 305 acts against inner surface 230A of hollow section 230 and switch 300, wherein flyleaf spring 305 keep constant tension on switch 300 constantly urging switch 300 upwardly away from inner surface 230A of hollow section 230 to opposed inner surface 230B of hollow section toward its locking position. Switch 300 is, therefore, spring-loaded, being constantly spring-tensioned toward its locking position. Upper end 241 of button 240 is applied to switch opening 231 and does not extend exteriorly of hollow section 230 beyond switch opening 231 for disabling inadvertent contact with upper end 241 of switch 300 and top side 250 of arm 245 is in contact against inner surface 230A of hollow section 230, when switch 300 is in its locking position in FIG. 24.

The operation of switch 300 for interconnecting first handle 211 of first member 201 to second handle 221 of second member 202 is substantially the same as switch 203 discussed above. Unlike switch 203, only one spring, flyleaf spring 305, spring loads switch 300. Briefly, second handle 221 is forcibly advanced through hollow section 230 in the direction of arrowed line A in FIG. 24 so as to bring tongue 224 in contact with ramp 255. Tongue 224 acts on ramp 255 in response to the continued advancement of second handle 221 into hollow section 230 of first handle 211, which overcomes flyleaf spring 305 and pivots switch 300 downwardly at pin 306 from its locking position in FIG. 24 away from inner surface 230B toward inner surface 230A, while at the same time withdrawing button 240 from switch opening 231 inwardly into hollow section 230. Continued advancement of second handle 221 in the direction of arrowed line A continues to drive tongue 224 against ramp 255 and pivot switch 300 downwardly at pin 306 in response until transom 226 clears ramp 255 and registers with strike 253 and ramp 255 concurrently registers with opening 225 of tongue 224, which enables flyleaf spring 305 to snap the downwardly-displaced arm 245 pivotally upwardly at pin 306 from its unlocked position back to its locked position in FIG. 24 in response, driving strike 253, the complemental engagement element of switch 300, over transom 226, the engagement element of second handle 221, while at the same time driving ramp 255 through opening 225. When transom 226 and registers with strike 253 and ramp 255 concurrently registers with opening 225, second handle 221 is in an installed position in hollow section 230 of first handle 211. When transom 226 is inserted into, i.e. penetrates, strike 253, transom 226 is releasably engaged to switch 300, which releasably engages second handle 221 to switch 300 disabling second handle 221 from being withdrawn from hollow section 230 of first handle 211. Strike 253 and transom 226 form a detent, a device used to mechanically secure second handle 221 to switch 300 for, in turn, connecting first handle 211 of first member 201 to second handle 221 of second member 202, thereby forming an assembled double-ended wrench corresponding to the embodiment of FIG. 16. There is sufficient clearance between pin 306 and socket 301 to enable pin 306 to pivot between the locked and unlocked position of switch 300, while at the same time retaining switch 300 in place to hollow section 230.

To separate first member 201 from second member 202 when second handle 221 is in its installed position in first handle 211 and when switch 300 is in its locking position, switch 300 is lowered pivotally away from its locking position toward inner surface 230A of hollow section 230 by pushing forcibly down on upper end 241 of button 240 at switch opening 231 by hand withdrawing strike 253 from transom 246 while at the same time withdrawing ramp 255 from opening 225 of tongue 224 and compressing flyleaf spring 257 between switch 300 and inner surface 230A of hollow section 230, enabling second handle 221 to be withdrawn from hollow section 230 of first handle 211 in the direction of arrowed line B in FIG. 24 until fully withdrawn from first handle 211. The process of coupling and decoupling first and second members 201 and 202 with switch 300 is repeated as necessary depending on whether the skilled worker selects to utilize an assembled double-ended wrench or to use first and second members 201 and 202 separately.

The present invention is described above with reference to illustrative embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A handle assembly, comprising:

a first handle including a switch having a proximal extremity, a distal extremity, an engagement member, and a projection mounted to the first handle for movement of the switch between an engaging position of the engagement member and a disengaging position of the engagement member, wherein the proximal extremity is in an undepressed position when the engagement member is in the engaging position, the proximal extremity is in a depressed position when the engagement member is in the disengaging position, and the proximal extremity is exteriorly operable by hand for movement between the undepressed position and the depressed position;

a second handle including a complemental engagement member;

the first handle sufficiently hollow to enable the second handle to be inserted into the first handle;

the second handle configured to act on the distal extremity of the switch to move the switch from the engaging position of the engagement member to the disengaging position of the engagement member, when the second handle is inserted into the first handle to a partially installed position;

the switch configured to move from the disengaging position of the engagement member to the engaging position of the engagement member releasably engaging the engagement member to the complemental engagement member disabling the second handle from being withdrawn from the first handle, when the engagement member registers with the complemental engagement member when the second handle is inserted into the first handle beyond the partially installed position to an installed position; and the second handle configured to abut the projection when the second handle advances through the first handle to the installed position from the partially installed position before the switch moves from the disengaging position of the engagement member to the engaging position of the engagement member, disabling the second handle from advancing into the first handle beyond the installed position.

2. The handle assembly according to claim 1, further comprising a spring that keeps tension on the switch urging the switch toward the engaging position of the engagement member.

3. The handle assembly according to claim 1, wherein the engagement member is one of a strike and a penetrator, and the complemental engagement member is the other one of the strike and the penetrator.

4. The handle assembly according to claim 1, wherein the projection is in direct contact against an inner surface of the first handle when the switch is in the engaging position of the engagement member, when the switch is in the disengaging position of the engagement member, and when the switch moves between the engaging position of the engagement member and the disengaging position of the engagement member.

5. The handle assembly according to claim 1, additionally comprising a wrenching component carried by the first handle.

6. The handle assembly according to claim 1, additionally comprising a wrenching component carried by the second handle.

7. The handle assembly according to claim 1, additionally comprising the switch configured to move from the engaging position of the engagement member to the disengaging position of the engagement member releasing the engagement member from the complemental engagement member enabling the second handle to be withdrawn from the first handle, when the second handle is in the installed position and when the switch is moved from the engaging position of the engagement member to the disengaging position of the engagement member.

* * * * *